US010854997B2

(12) United States Patent
Quitt

(10) Patent No.: US 10,854,997 B2
(45) Date of Patent: Dec. 1, 2020

(54) ANTENNA ARRAY WITH AT LEAST ONE DIPOLE-TYPE EMITTER ARRANGEMENT

(71) Applicant: Telefonaktiebolaget LM Ericsson (publ), Stockholm (SE)

(72) Inventor: Markus Quitt, Rohrdorf (DE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 0 days.

(21) Appl. No.: 16/315,024

(22) PCT Filed: Jul. 4, 2017

(86) PCT No.: PCT/EP2017/066561
§ 371 (c)(1),
(2) Date: Jan. 3, 2019

(87) PCT Pub. No.: WO2018/007348
PCT Pub. Date: Jan. 11, 2018

(65) Prior Publication Data

US 2019/0312362 A1 Oct. 10, 2019

(30) Foreign Application Priority Data

Jul. 5, 2016 (DE) ..... 10 2016 112 257

(51) Int. Cl.
*H01Q 25/00* (2006.01)
*H01Q 1/24* (2006.01)
(Continued)

(52) U.S. Cl.
CPC ..... *H01Q 25/001* (2013.01); *H01Q 1/241* (2013.01); *H01Q 1/246* (2013.01); *H01Q 5/385* (2015.01); *H01Q 9/28* (2013.01); *H01Q 19/30* (2013.01)

(58) Field of Classification Search
CPC ..... H01Q 25/001; H01Q 19/30; H01Q 1/246; H01Q 5/385; H01Q 1/241; H01Q 9/28
See application file for complete search history.

(56) References Cited

U.S. PATENT DOCUMENTS 7,692,601 B2 * 4/2010 Bisiules ..... H01P 5/103 343/797
2004/0183739 A1 9/2004 Bisiules et al.
(Continued)

FOREIGN PATENT DOCUMENTS

CN 1577974 A 2/2005
CN 101080848 A 11/2007
(Continued)

OTHER PUBLICATIONS

Su et al. English Translation of CN 101505007 A, Published Aug. 12, 2009, 5 pages. (Year: 2009).*
(Continued)

*Primary Examiner* — Daniel D Chang
(74) *Attorney, Agent, or Firm* — Sage Patent Group

(57) ABSTRACT

An antenna array (20) with at least one dipole-type emitter arrangement (1), wherein the at least one dipole-type emitter arrangement (1) comprises two pairs (2, 3) of emitter halves (2*a*, 2*b*, 3*a*, 3*b*), which transmit and/or receive on two polarization planes (4*a*, 4*b*) that are perpendicular to one another. The emitter halves (2*a*, 2*b*, 3*a*, 3*b*) can be or are arranged on an emitter plane (5) at a distance from a reflector (6) and run parallel to said reflector. Two electrically conductive partial circumferential frames (15*a*, 15*b*, 15*c*) are provided, which are disposed between the emitter plane (5) and the reflector (6) at a distance from one another, wherein the at least two electrically conductive partial circumferential frames (15*a*, 15*b*, 15*c*) define one opening (17). The at least two partial circumferential frames (15*a*, 15*b*, 15*c*) are oriented parallel to the emitter plane (5). Each of the two
(Continued)

partial circumferential frames (15*a,* 15*b,* 15*c*) comprises at least one gap (16), which extends through the entire width of the partial circumferential frame (15*a,* 15*b,* 15*c*), so that each partial circumferential frame (15*a,* 15*b,* 15*c*) comprises at least two ends.

21 Claims, 10 Drawing Sheets

(51) Int. Cl.

| | |
|---|---|
| ***H01Q 9/28*** | (2006.01) |
| ***H01Q 19/30*** | (2006.01) |
| ***H01Q 5/385*** | (2015.01) |

(56) References Cited

U.S. PATENT DOCUMENTS

| | | | | |
|---|---|---|---|---|
| 2004/0263392 | A1* | 12/2004 | Bisiules | H01Q 1/246 343/700 MS |
| 2006/0114168 | A1* | 6/2006 | Gottl | H01Q 1/246 343/797 |
| 2006/0232490 | A1 | 10/2006 | Bisiules et al. | |
| 2008/0111757 | A1 | 5/2008 | Bisiules et al. | |
| 2011/0043425 | A1 | 2/2011 | Timofeev et al. | |
| 2017/0264021 | A1* | 9/2017 | Heyde | H01Q 9/285 |

FOREIGN PATENT DOCUMENTS

| | | |
|---|---|---|
| CN | 101 505 007 | 8/2009 |
| CN | 202839949 U | 3/2013 |
| CN | 203386887 | 1/2014 |
| CN | 104604028 A | 5/2015 |
| CN | 105720361 A | 6/2016 |
| DE | 196 27 015 | 1/1998 |
| DE | 197 22 742 | 12/1998 |
| EP | 1 496 569 | 1/2005 |
| EP | 1 751 821 | 2/2007 |
| EP | 2 950 385 | 12/2015 |
| WO | 2000/39894 | 7/2000 |
| WO | 2004/100315 | 11/2004 |
| WO | 2005/060049 | 6/2005 |

OTHER PUBLICATIONS

International Search Report and Written Opinion of the ISA for PCT/EP2017/066561, dated Sep. 19, 2017, 17 pages.

English translation of the International Preliminary Report on Patentability and Written Opinion of the International Searching Authority dated Jan. 17, 2019, issued in International Application No. PCT/EP2017/066561, 10 pages.

He, et al.; "Broadband Dual-Polarized Omnidirectional Antenna for 2G/3G/LTE/WiFi Applications"; IEEE Antennas and Wireless Propagation Letters, vol. 15, 2016; pp. 576-579.

CNIPA Search Report for corresponding CN201780039684.8, dated May 19, 2020.

* cited by examiner

ANTENNA ARRAY WITH AT LEAST ONE DIPOLE-TYPE EMITTER ARRANGEMENT

This application is the U.S. national phase of International Application No. PCT/EP2017/066561 filed 4 Jul. 2017, which designated the U.S. and claims priority to DE Patent Application No. 10 2016 112 257.2 filed 5 Jul. 2016, the entire contents of each of which are hereby incorporated by reference.

The invention relates to an antenna array comprising at least one dipole-type radiator arrangement according to the preamble of claim 1.

Dipole radiators are known for example from the prior publications DE 197 22 742 A and DE 196 27 015 A. In this case, dipole radiators of this kind may have a conventional dipole structure or may for example consist of a crossed dipole or a quad dipole, etc.

What is known as a vector dipole is known for example from the prior publication WO 00/39894 A1. The structure of said dipole appears to be comparable to that of a quad dipole. However, owing to the specific design of the dipole radiator according to said prior publication and the particular power supply, said dipole radiator functions in a manner similar to a crossed dipole that radiates in two mutually perpendicular polarisation planes. In structural terms, said radiator is actually quadratic, in particular owing to the design of the outer contour thereof.

WO 2004/100315 A1 discloses a further embodiment of the above-mentioned vector dipole, in which the surfaces of one radiator half in each case can be largely completely closed with respect to one polarisation.

Dipole radiators of this kind are usually supplied with power in such a way that one dipole or radiator half is connected in a direct current configuration (i.e. galvanically) to an outer conductor, whereas the inner conductor of a coaxial connection cable is connected in a direct current configuration (i.e. again galvanically) to the second dipole or radiator half. In this case, the power is supplied in each case to the mutually facing end regions of the dipole or radiator halves.

WO 2005/060049 A1 discloses implementing an outer conductor power supply using a capacitive outer conductor coupling. For this purpose, the associated halves of the carrier means of the radiator arrangement can in each case be galvanically connected to ground or capacitively coupled to ground at the foot region or at the base of the carrier means.

CN 203386887 U discloses a dipole-type radiator arrangement comprising two pairs of radiator halves that are arranged having a mutual rotational offset of 90°, with the result that the dipole-type radiator arrangement transmits in two mutually perpendicular polarisation planes. Furthermore, a passive beam-forming frame is shown, which is arranged so as to be in parallel with and spaced apart from the radiator halves in the direction of the reflector. Furthermore, a director is shown which is arranged in parallel with the radiator halves, the radiator halves being arranged closer towards the reflector than the director is.

US 2008/0111757 A1 discloses a dual polarised antenna. Said antenna comprises partially circular radiator elements which are surrounded by a common circular radiator element. All the radiator elements are break-free and are arranged in a common plane.

US 2011/0043425 A1 discloses an antenna system. The antenna system comprises "high band" elements and "low band" elements, said low band elements being annular. Two annular "low band" elements are arranged in different planes and in this case surround a "high band" element. The "low band" elements are break-free.

US 2006/0232490 A1 discloses an antenna system comprising a crossed-dipole and a microstrip ring. In this case, the crossed-dipole is surrounded by the microstrip ring which may consist of a plurality of break-free rings which are arranged in different planes. In this case, the lowest ring is supplied with power by means of four T-shaped supply structures, coupling taking place from the lower to the upper ring.

A disadvantage of the radiator arrangements from the prior art is that the bandwidth of the radiator arrangements is too small for many applications.

The object of the present invention is therefore that of providing a dipole-type radiator arrangement that can be used in mobile communications antennae and the bandwidth of which is higher than that of the radiator arrangements known from the prior art.

The object is achieved by the antenna array comprising at least one dipole-type radiator arrangement, according to claim 1. Developments, according to the invention, of the antenna array comprising at least one or at least two dipole-type radiator arrangements are specified in the dependent claims.

The dipole-type radiator arrangement comprises two pairs of radiator halves that are arranged having a mutual rotational offset of 90°, such that the dipole-type radiator arrangement transmits and/or receives in two mutually perpendicular polarisation planes. Two radiator halves, which in this case form one pair, are arranged so as to be diagonal relative to one another. The radiator halves can be or are arranged in a radiator plane so as to be in parallel with and at a spacing in front of a reflector. A balancing and/or carrier assembly comprising a first end and a base at a second end that is opposite the first end is used to retain the two radiator halves, said halves being arranged on the first end of the carrier assembly. The base of the carrier assembly is or can be fastened to a base body. Said base body is for example a plate or a reflector, an at least indirect fastening to the reflector preferably being achieved by the plate. In order to additionally increase the bandwidth, at least two electrically conductive partially circumferential frames are provided, which frames are arranged between the radiator plane and the base so as to be mutually spaced in the height direction of (i.e. along) the carrier assembly, the at least two electrically conductive partially circumferential frames each defining or surrounding an opening. In this case, the at least two partially circumferential frames are oriented approximately in parallel with the radiator plane. Each of the two partially circumferential frames comprises at least one break which extends through the entire width of the partially circumferential frame, such that each partially circumferential frame comprises at least two ends. This achieves a bandwidth that has hitherto not been reached. Frequency ranges that were previously covered by at least two different radiators and/or columns or rows of antennae can now be radiated by means of just one system. This means that it is now possible to save on at least one antenna, resulting in a significant cost saving. This advantage is not achieved by means of an antenna system according to EP 1 496 569 A1 either, in which either a plurality of passive radiators in the form of closed rings, or at least one actively supplied radiator, also in the form of a closed ring, is arranged below the radiator plane.

According to a preferred embodiment of the antenna array, the at least two ends of each partially circumferential frame, which ends are formed by the at least one break, face one another. This means that the breaks in each case extend over only a smaller length of the corresponding partially circumferential frame (but still over the entire width). In this case, the length of the break can be less than 1 cm, preferably less than 5 mm. It is therefore possible to refer to a slot rather than a break.

The at least two partially circumferential frames are preferably approximately mutually parallel, but still galvanically separated from one another. In particular, with the exception of the break, the at least two partially circumferential frames overlap one another in plan view, at least completely or at least in part. As a result, coupling between the at least two partially circumferential frames can be increased, with the result that the bandwidth increases further.

According to a further embodiment, in a plan view of each of the partially circumferential frames, the at least one break extends over less than 30%, preferably over less than 20%, more preferably over less than 10%, even more preferably over less than 5% of the length of the partially circumferential frame. In this case it would also be possible, in principle, for the two partially circumferential frames to be arranged so as to have a mutual rotational offset. Good results are achieved when the breaks in the at least two partially circumferential frames overlap only in part or do not overlap at all. In the latter case, in a plan view of the partially circumferential frames the breaks are not directly above one another, i.e. arranged in a straight line that extends perpendicularly to the radiator plane.

According to another embodiment of the invention, each partially circumferential frame comprises a plurality of breaks, with the result that a plurality of partially circumferential frame segments are formed. This means that the partially circumferential frame is divided into a plurality of partially circumferential frame segments. Said partially circumferential frame segments can all be of the same length. However, in a particular embodiment it is also possible for one of said partially circumferential frame segments to be longer than others or to be longer than all other partially circumferential frame segments.

The partially circumferential frames are preferably arranged so as to be symmetrical relative to one another with respect to the relevant break or breaks thereof. This means that the breaks in the at least two partially circumferential frames are arranged having a rotational offset of 360°/n with respect to one another, n being the number of all the breaks in the at least two partially circumferential frames. In the event of there being two partially circumferential frames and each partially circumferential frame comprising exactly one break, n is assigned the value 2. In this case, the breaks should be arranged so as to have a mutual rotational offset of 360°/2 (=180°). A corresponding arrangement according to the above formula is also desirable in the event of there being three, four or five partially circumferential frames.

In a preferred embodiment, in plan view the at least two partially circumferential frames are approximately circular or approximately describe a circle overall. However, it is possible in principle for the partially circumferential frames to also be of a different shape, for example square and/or rectangular. Said frames may also be oval. In general, an n-polygonal shape is therefore possible. Preferably, however, all the partially circumferential frames are of the same shape in plan view, it being possible for said frames to have a rotational offset with respect to one another. Within this application, a rotational offset with respect to one another is intended to be understood to mean that the centres or the centres of gravity of the at least two partially circumferential frames are still arranged on top of one another, in plan view, following rotation. A straight line extending through said points would preferably be perpendicular to the radiator plane. The at least two partially circumferential frames preferably have the same inside diameters and the same outside diameters. It would also be possible, however, for only the inside diameters or only the outside diameters to be the same. Furthermore, it would also be conceivable for neither the inside diameters nor the outside diameters of the at least two frames to be the same. Accordingly, it would be conceivable for all the partially circumferential frames to have different geometries. It would also be possible for the at least two partially circumferential frames to be arranged so as to be offset with respect to one another by a particular length, said frames again overlapping, in plan view, at least in part. The overlap preferably occurs over the entire length of the partially circumferential frames, with the exception of the breaks in each case, but not necessarily over the entire width. The overlap may also occur over only a partial width. With the exception of the break, the at least two partially circumferential frames are preferably symmetrical, in particular radially symmetrical. The at least two partially circumferential frames are preferably of approximately the same width in plan view. It may also be possible for one frame to be wider than the other frame. This relates not only to the diameter, but rather also to the width of the actual frame connecting piece of the partially circumferential frame.

In another development, the at least two partially circumferential frames comprise a plurality of frame portions which are continuous, the spacings between the individual frame portions and a longitudinal axis that passes through the centre of the dipole-type radiator arrangement changing alternately from a larger spacing to a smaller spacing and vice versa. In this case, the individual frame portions are preferably interconnected by means of an approximately radially extending connecting portion. As a result, the partially circumferential frames may have a meandering or cog-like basic structure in plan view. The at least two partially circumferential frames thus formed are arranged, together with the alternating frame portions thereof (with the exception of the break), so as to be congruent or so as to have a mutual rotational offset in plan view. Depending on how much said frames overlap, different heights of the coupling can be set.

At least one dielectric medium is inserted between the at least two partially circumferential frames. In a plan view of the dipole-type radiator arrangement, the shape of the dielectric medium is matched to the shape of the relevant partially circumferential frame. In a plan view of the dipole-type radiator arrangement, the at least one dielectric medium is arranged so as to be congruent with or so as to have a rotational offset with respect to one or both of the partially circumferential frames. The height of the coupling can again be set thereby. The dielectric medium can also be created by means of one or all of the partially circumferential frames being hard-anodised, as a result of which an insulating hard-anodised layer is formed.

In another embodiment, the dipole-type radiator arrangement additionally comprises a director, the director being oriented so as to be in parallel with the radiator plane. In this case, the radiator halves are arranged closer to the base than the director is. The director may have a round, rectangular, oval or generally n-polygonal basic structure in plan view. Said basic structure is preferably largely free of openings.

In order to achieve simple, preferably tool-free assembly, the dipole-type radiator arrangement comprises at least one retaining and spacer element. In this case, said element surrounds and/or retains the at least two partially circumferential frames. In addition or alternatively, the retaining and spacer element in this case rests on the outer surfaces of the two outermost partially circumferential frames. In this case the partially circumferential frames are for example arranged, together with a dielectric medium located therebetween, in a sandwich-like manner in the retaining and spacer element. In this case, the retaining and spacer element may further comprise a retaining clamp or be in the shape of a retaining clamp, said clamp being designed to also apply an additional retaining force to the assembly consisting of the partially circumferential frame and the dielectric medium. This is not necessary, however. The retaining clamp is preferably U-shaped or is in a shape similar to said shape.

In order for the assembly to be simpler and more reproducible, the at least one retaining clamp comprises a support portion. The support portion is arranged inside the break in a partially circumferential frame, as a result of which the two end faces of the two ends, which ends are formed on the partially circumferential frame by means of the break, are supported on the support portion. In this manner, the individual partially circumferential frames can be oriented so as to be mutually symmetrical because at least one support portion of a retaining clamp preferably engages in each break. This also ensures that the partially circumferential frames are arranged on the dipole-type radiator arrangement so as to be non-rotatable after assembly. In general terms, it would also be possible for the at least two partially circumferential frames to be releasably connected to the at least one retaining and spacer element by means of a clip or snap connection.

In order to further improve the stability of the dipole-type radiator arrangement, in another embodiment the retaining and spacer element comprises a support profile. In this case, the support profile is matched to the contour of at least one partially circumferential frame and is of a length that corresponds to at least a partial length of the partially circumferential frame. The inner face of the at least one partially circumferential frame is supported on the at least one support profile or on the outer face thereof. This increases the stability of the entire assembly and simultaneously ensures that the partially circumferential frames are oriented in a stationary manner and remain oriented in a stationary manner after successful assembly.

In order to further simplify the assembly, the at least one retaining and spacer element is retained on one or on all radiator halves or directly on the carrier assembly by means of a preferably releasable force-locked and/or form-locked connection which is preferably a clip or snap connection. It is thus possible to omit any screw connections. Other types of force-locked and/or form-locked connection are also conceivable. These include for example a bayonet joint. The at least one retaining and spacer element may also comprise a spacer, for example in the form of the dielectric medium. Said spacer is then inserted between the individual partially circumferential frames and ensures the galvanic isolation. The retaining and spacer element is preferably formed in one piece together with the spacer and/or the dielectric medium. Production is preferably carried out by means of a plastics injection-moulding process.

Different embodiments of the invention will be described in the following, by way of example and with reference to the drawings. The same elements are provided with the same reference signs. In the corresponding figures, in detail:

Figure 1:
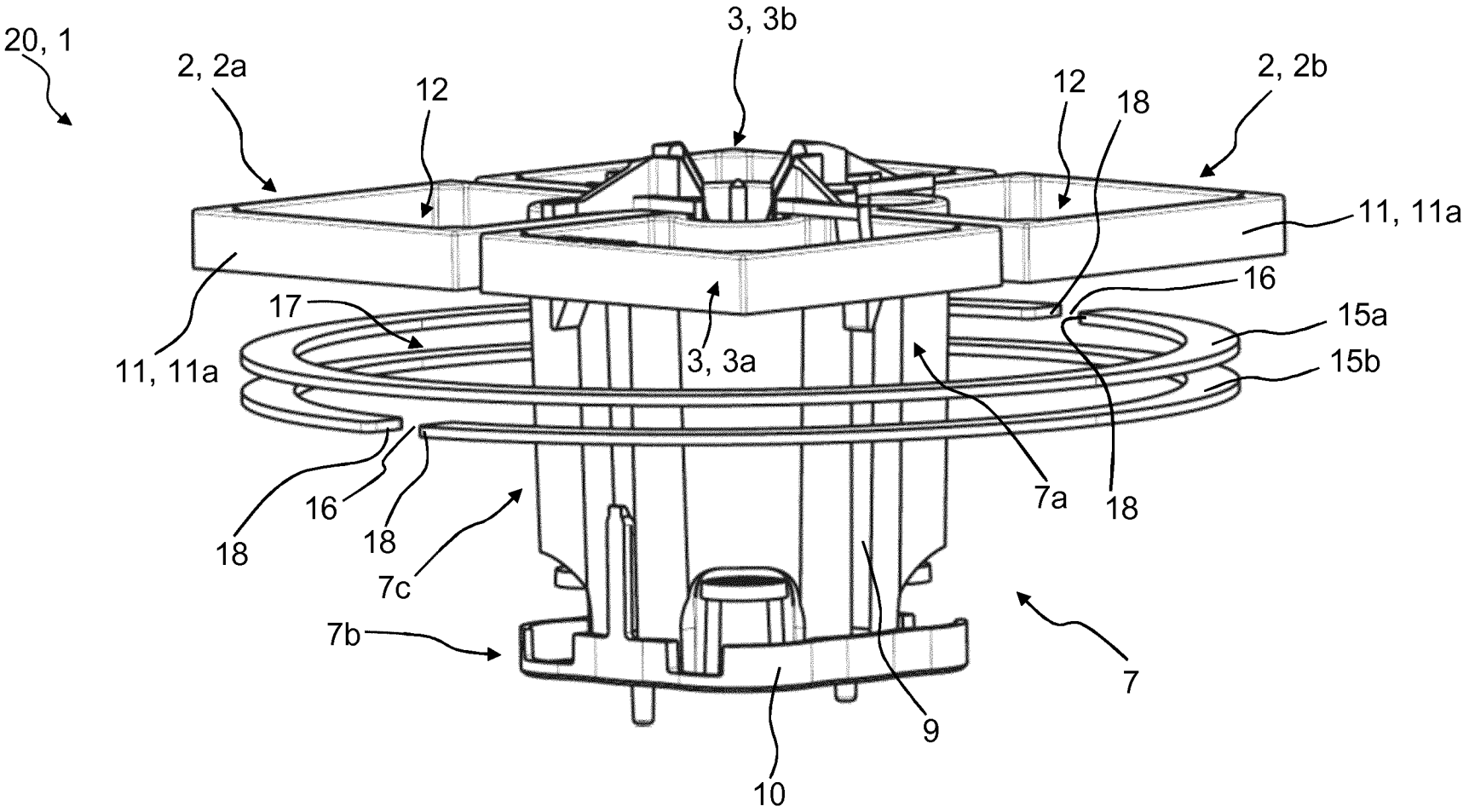
FIGS. 1 and 2 are different spatial views of an antenna array according to the invention comprising a dipole-type radiator arrangement.
Figure 2:
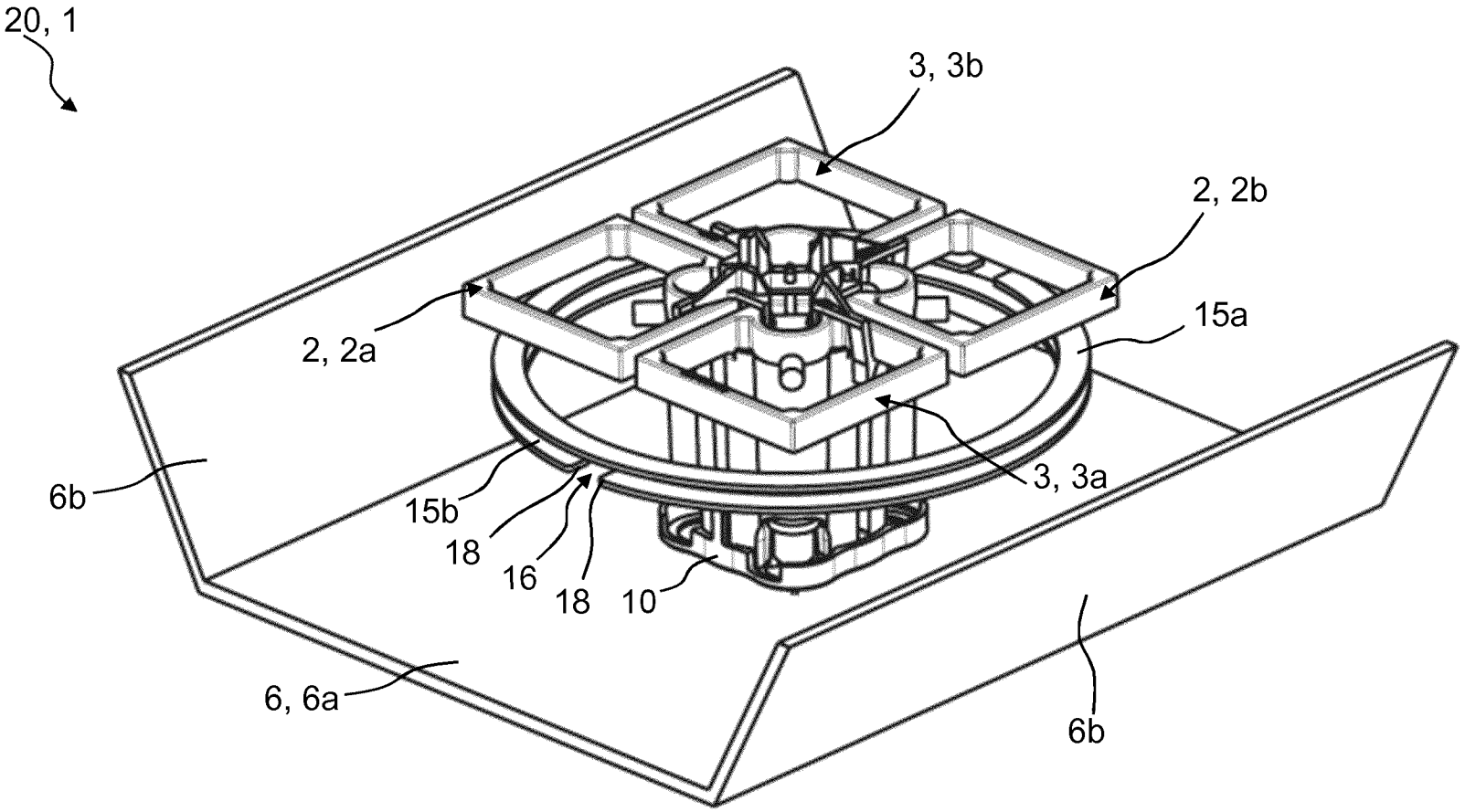
Figure 4:
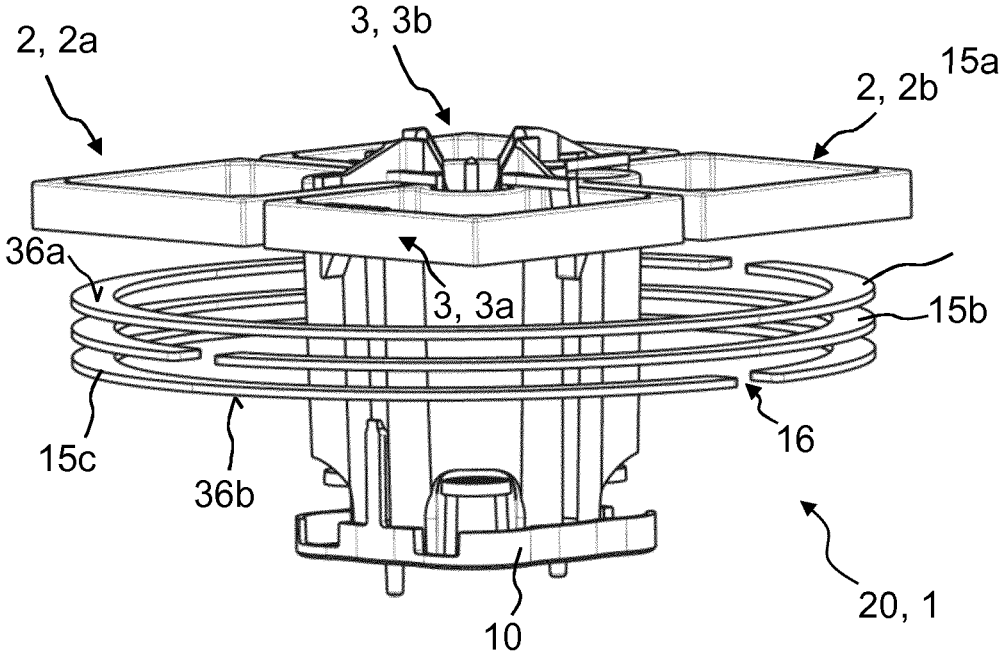
FIG. 4 is a further view of the dipole-type radiator arrangement according to a further embodiment according to the invention.

FIGS. 1, 2 and 4 are spatial views of an antenna array 20 according to the invention comprising at least one dipole-type radiator arrangement 1. The dipole-type radiator arrangement 1 comprises two pairs 2, 3 of radiator halves 2*a*, 2*b*, 3*a*, 3*b*. Said two pairs 2, 3 of radiator halves 2*a*, 2*b* and 3*a*, 3*b*, respectively, can be seen clearly in particular in the plan view in FIG. 7C, which figure shows an antenna array 20 comprising at least two dipole-type radiator arrangements 1. Said two pairs 2, 3 of radiator halves 2*a*, 2*b* and 3*a*, 3*b*, respectively, are arranged having a mutual rotational offset of 90°, such that the dipole-type radiator arrangement 1 transmits and/or receives in two mutually perpendicular polarisation planes 4*a*, 4*b* (FIG. 7C). In this case, the radiator halves 2*a*, 2*b*, and 3*a*, 3*b*, respectively, are oriented in a radiator plane 5. Said radiator plane 5 is shown for example in FIG. 7B, which is a side view of the antenna array 20 comprising at least two dipole-type radiator arrangements 1. The radiator halves 2*a*, 2*b*, and 3*a*, 3*b*, respectively, are or can be arranged in parallel with and so as to be at a spacing in front of a reflector 6. The reflector 6 is shown in FIG. 2.

The dipole-type radiator arrangement 1 further comprises a balancing and/or carrier assembly 7, referred to in the following as the carrier assembly 7, which comprises a first end 7*a* and a second end 7*b*. The second end 7*b* is opposite the first end 7*a*. The radiator halves 2*a*, 2*b*, and 3*a*, 3*b*, respectively, are arranged on the first end 7*a* of the carrier assembly 7. The second end 7*b* of the carrier assembly 7 can be or is fastened at least indirectly to the reflector 6. Indirect fastening may be provided for example if the second end 7*b* of the carrier assembly 7 is fastened to a circuit board 21, it being possible for a metal layer of said circuit board 21 to simultaneously form the reflector 6. A circuit board 21 of this kind is shown in FIG. 7A to 8C for example. A separate reflector 6 below the circuit board 21 could also be provided. Direct fastening to the reflector 6 would then be provided if the second end 7*b* of the carrier assembly 7 is directly fastened to the reflector 6. This situation is shown in FIG. 2. The reflector 6 and/or the circuit board 21 can also be referred to as the base body. The second end 7*b* of the carrier assembly 7 may also be referred to as the base 10.

The carrier assembly 7 consists of and/or comprises a carrier 7*c*. The carrier assembly in particular comprises one carrier 7*c*, in each case, for each radiator half 2*a*, 2*b* and 3*a*, 3*b*, respectively. With reference to FIG. 1, there are therefore four carriers 7*c*. Each of said carriers 7*c* extends along a longitudinal axis 8 so as to be substantially or exclusively in parallel therewith (see FIGS. 7B and 8B), which axis passes through the centre of the dipole-type radiator arrangement 1. The carriers 7*c* are galvanically connected to the radiator halves 2*a*, 2*b* and 3*a*, 3*b*, respectively, at the first end 7*a*, i.e. at the first end 7*a* of the carrier assembly 7. Capacitive coupling of the carrier 7*c* to the first end 7*a* of the carrier assembly 7 would also be possible. A gap 9 is formed between two carriers 7*c* in each case, which gap preferably extends from the first end 7*a* to the second end 7*b* and is used for balancing. The carriers 7 are preferably galvanically interconnected at the second end 7*b* of the carrier assembly 7, i.e. at the base 10 thereof.

The dipole-type radiator arrangement 1 is preferably supplied with power such that two cables, each having an inner and an outer conductor, are each connected to one pair 2, 3, of the radiator halves 2*a*, 2*b* and 3*a*, 3*b*, respectively. The outer conductor of the first cable is connected to a first radiator half 2*a* of the first pair 2. In contrast, the inner conductor of the first cable is connected to the second radiator half 2*b* of the first pair 2. In contrast, the outer conductor of the second cable is connected to the first radiator half 3*a* of the second pair 3. In contrast, the inner conductor of the second cable is accordingly connected to the second radiator half 3*b* of the second pair 3. The inner conductors therefore intersect. The connection preferably takes place at the first end 7*a* of the carrier assembly 7. It would in principle also be possible for the outer conductors to intersect.

With regard to the power supply and the balancing, reference is made to the documents cited in the introduction to the description.

With respect to FIGS. 1, 2, 4, 7C and 8C it is possible to see that the radiator halves 2*a*, 2*b* and 3*a*, 3*b*, respectively, comprise a substantially square radiator frame 11. The radiator frames 11 of the radiator halves 2*a*, 2*b* and 3*a*, 3*b* each comprise a recess 12 that surrounds an opening. Each radiator frame 11 consists of four sides, two sides of a radiator frame 11 in each case being arranged so as to be in parallel with two other sides of another radiator frame 11. A gap 13 is provided between two radiator frames 11. Said gap 13 transitions into the gap 9 of the carrier assembly 7. More precisely, the gap 13 is formed between two inner faces of the radiator halves 2*a*, 2*b* and 3*a*, 3*b*, respectively, which faces extend so as to be mutually parallel. The radiator halves 2*a*, 2*b* and 3*a*, 3*b*, respectively, are supplied with power at the point at which two inner faces 11*b* of one radiator half 2*a*, 2*b* or 3*a*, 3*b* meet. Each inner face 11*b* is connected to one outer face 11*a*, respectively. The outer corner is preferably chamfered at the point at which two outer faces 11*a* meet (not shown).

The radiator halves 2*a*, 2*b*, and 3*a*, 3*b*, respectively, may also be formed without a recess 12. In FIGS. 7C and 8C, the sides of the recess 12 are arranged so as to be in parallel with the sides of the radiator frame 11. The sides of the recess 12 may also be rotated by an angle, in particular of 45°, with respect to the sides of the radiator frame 11. In this case, the recesses 12 of the radiator frame 11 are in the shape of a square in plan view. However, said recesses could be of a general rectangular shape or of another cross-sectional shape. This means that the size and shaping of the recesses 12 can be selected in a variable manner, within a wide range.

The first corners of the radiator frames 11 of the radiator halves 2*a*, 2*b* and 3*a*, 3*b*, respectively, are connected to the first end 7*a* of the individual carriers 7*c* of the carrier assembly 7. A further corner of the radiator frames 11 of the radiator halves 2*a*, 2*b* and 3*a*, 3*b*, respectively, that is opposite the relevant first corner, preferably diametrically opposite thereto, is optionally chamfered. The other corners are preferably less chamfered or not chamfered. The chamfered corners are the corners of the radiator frames 11 that are furthest from the longitudinal axis 8.

With regard to FIGS. 1, 2 and 4, at least two electrically conductive partially circumferential frames 15*a*, 15*b* are additionally provided, which frames are arranged between the radiator plane 5 and the base 10 so as to be mutually spaced in the height direction of the carrier assembly 7. The at least two electrically conductive partially circumferential frames 15*a*, 15*b* each define or surround an opening 17. The at least two partially circumferential frames 15*a*, 15*b* are oriented in parallel with the radiator plane 5. Said frames are preferably also approximately mutually parallel. The term "approximately" is to be understood to mean that the at least two partially circumferential frames 15*a*, 15*b* may also be inclined towards one another by a few degrees, preferably by less than 5°, more preferably by less than 3°, even more preferably by less than 1°.

Each of the at least two partially circumferential frames 15*a*, 15*b* comprises at least one break 16. In this case, the break 16 passes through the entire width of the relevant partially circumferential frame 15*a*, 15*b* at at least one point, such that each partially circumferential frame 15*a*, 15*b* comprises at least two ends 18.

The at least two ends 18 of the partially circumferential frames 15*a*, 15*b*, which ends are formed by the at least one break 16, face one another. The breaks 16 preferably extend over only a specified length of the relevant partially circumferential frame 15*a*, 15*b*, and therefore the breaks 16 can also be referred to as slots.

The partially circumferential frames 15*a*, 15*b* consist of an electrically conductive material or are coated with an electrically conductive material.

The partially circumferential frames 15*a*, 15*b* are preferably produced in a punching process, the relevant breaks 16 for example also already being made in said process.

FIGS. 1, 2, and 4 do not show that a dielectric medium 19 is inserted between the partially circumferential frames 15*a*, 15*b*, which medium simultaneously also functions as a spacer, such that the at least two partially circumferential frames 15*a*, 15*b* are galvanically separated from one another. However, the spacing between the individual partially circumferential frames 15*a*, 15*b* could also be achieved by mounting the individual partially circumferential frames 15*a*, 15*b*. In this case, air would act as the dielectric medium.

The at least two partially circumferential frames 15*a*, 15*b* are in particular also galvanically separated from the carrier assembly 7 and the radiator halves 2*a*, 2*b*, 3*a*, 3*b*, and more particularly galvanically separated from all other elements.

The at least two partially circumferential frames 15*a*, 15*b* are in particular arranged so as to be closer to the reflector 6 or the common base body 6, 21 on which the base 10 of the carrier assembly 7 is arranged than all the (directly) supplied radiator halves 2*a*, 2*b*, 3*a*, 3*b* or all the (directly) supplied radiators.

Figure 3A:
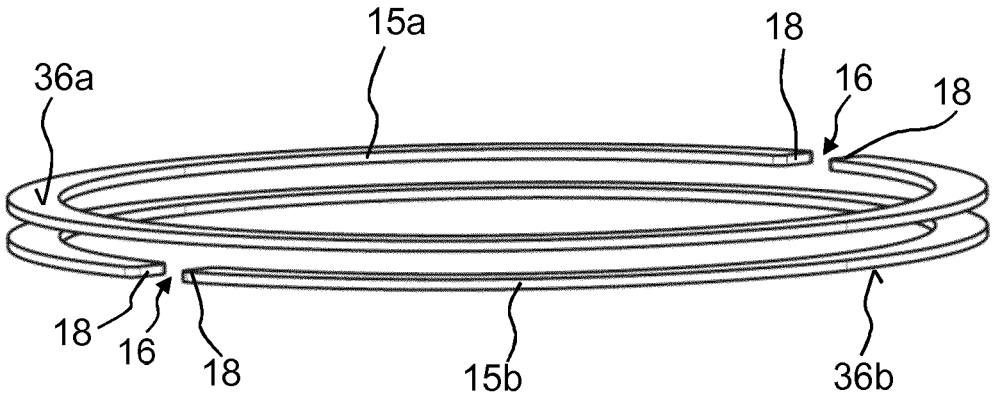
FIGS. 3A and 3B are different spatial views of two mutually parallel partially circumferential frames.
Figure 3B:
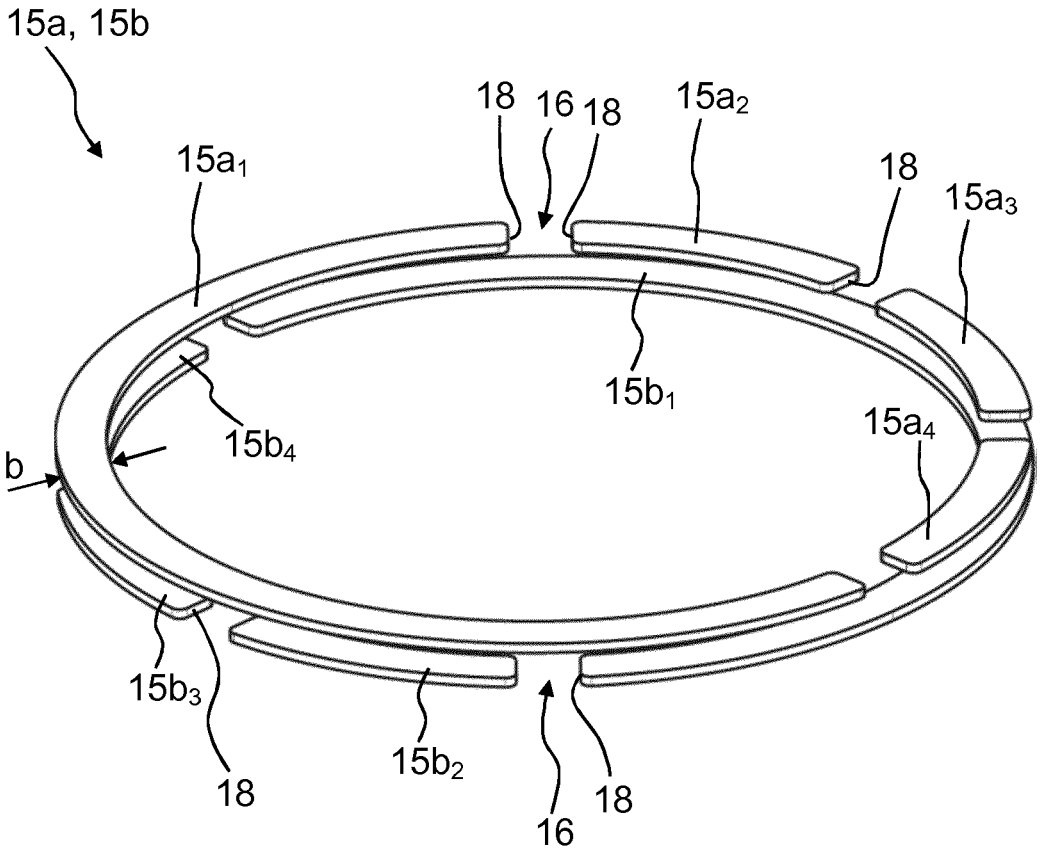

FIG. 3A shows the two partially circumferential frames 15*a*, 15*b* from FIGS. 1 and 2 in isolation. In a plan view of each of the partially circumferential frames 15*a*, 15*b*, the at least one break 16 extends over less than 30%, preferably over less than 20%, more preferably over less than 10%, even more preferably over less than 5%, of the length of the partially circumferential frame 15*a*, 15*b*.

The at least two partially circumferential frames 15*a*, 15*b* are arranged so as to have a mutual rotational offset. This means that the breaks 16 in the at least two partially circumferential frames 15*a*, 15*b* do not overlap at all. This achieves a very high bandwidth. It would also be possible, in principle, for the breaks 16 to overlap in part. A complete overlap, i.e. a congruent arrangement of the breaks 16, is not desirable.

The breaks 16 in the at least two partially circumferential frames 15*a*, 15*b* preferably have a rotational offset of $\alpha=360°/n$ with respect to one another, n being the sum of the total number of breaks 16 in the at least two partially circumferential frames 15*a*, 15*b*. In this case, n has a value of two because there are a total of two breaks 16 in the partially circumferential frames 15*a*, 15*b*. Consequently, the two breaks 16 have a rotational offset of $\alpha=180°$ with respect to one another.

With respect to FIG. 2B, the partially circumferential frames 15*a*, 15*b* comprise a plurality of breaks 16, with the result that each partially circumferential frame 15*a*, 15*b* is divided into a plurality of partially circumferential frame segments $\mathbf{15}a_1$, $\mathbf{15}a_2$, $\mathbf{15}a_3$, $\mathbf{15}a_4$; $\mathbf{15}b_1$, $\mathbf{15}b_2$, $\mathbf{15}b_3$, $\mathbf{15}b_4$. In this case, it is possible for one of the partially circumferential frame segments $\mathbf{15}a_1$, $\mathbf{15}b_1$ of one of the partially circumferential frames 15*a*, 15*b* to be longer than the other partially circumferential frame segment(s) $\mathbf{15}a_2$, $\mathbf{15}a_3$, $\mathbf{15}a_4$, $\mathbf{15}b_2$, $\mathbf{15}b_3$, $\mathbf{15}b_4$ of the relevant partially circumferential frame 15*a*, 15*b*. Said partially circumferential frame segments could alternatively also all be of the same length.

In this case, the breaks 16 are preferably all of the same size. However, said breaks may differ with respect to the size and to the shape thereof.

The at least two partially circumferential frames 15*a*, 15*b* are approximately circular in plan view. In this embodiment, in a plan view the at least two partially circumferential frames 15*a*, 15*b* overlap fully, i.e. completely, with the exception of the break 16 in each case. It would also be possible for the at least two partially circumferential frames 15*a*, 15*b* to overlap only in part, with the exception of the break 16 in each case, in a plan view. This would be the case when one partially circumferential frame 15*a* is arranged so as to be offset relative to another partially circumferential frame 15*b*, the offset being transverse to the longitudinal axis 8. Furthermore, overlap only in part could also be achieved by the (inside/outside) diameter of one partially circumferential frame 15*a* being smaller or larger than the diameter of the at least one other partially circumferential frame 15*b*. Overlap only in part could also be achieved by means of a varying width b of the relevant frame connecting piece of a partially circumferential frame 15*a*, 15*b*.

The width b of the partially circumferential frame 15*a*, 15*b* does not need to be constant. Said width can also vary within a partially circumferential frame 15*a*, 15*b*, over the length thereof.

Other shapes for the at least two partially circumferential frames 15*a*, 15*b* would also be possible. Thus, in plan view said frames may for example be in the shape of an oval, a rectangle (in particular a square) or in a very general manner the shape of an n-polygon.

Figure 5:
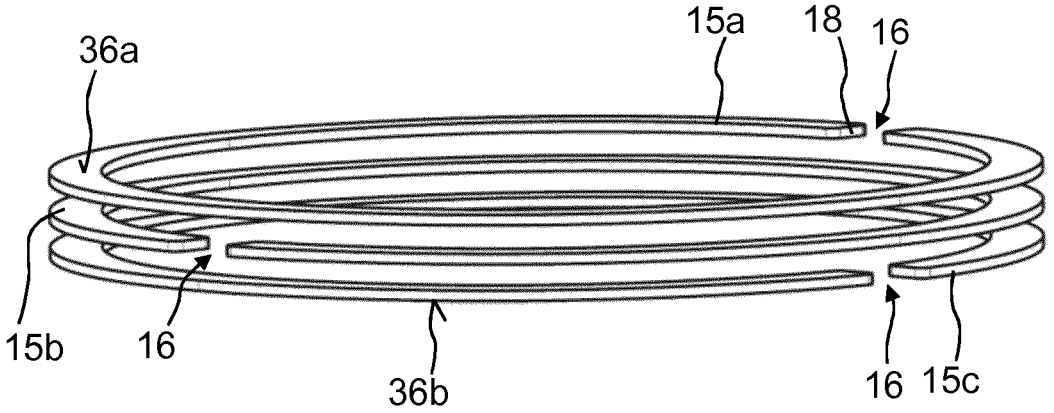
FIG. 5 is a further view of three mutually parallel partially circumferential frames.

FIG. 4 shows a dipole-type radiator arrangement 1 comprising three mutually parallel partially circumferential frames 15*a*, 15*b*, 15*c*. Each of said at least three partially circumferential frames 15*a*, 15*b*, 15*c* comprises at least one break 16. FIG. 5 is a further, separate, view of the at least three partially circumferential frames 15*a*, 15*b*, 15*c*. All three partially circumferential frames 15*a*, 15*b*, 15*c* surround an opening 17 through which the carrier assembly 7 is guided. The respective breaks 16 are shown without an overlap. An "overlap" is to be understood to mean that the breaks 16 in three adjacent partially circumferential frames 15*a*, 15*b*, 15*c* are not congruent in plan view. The break 16 in the first partially circumferential frame 15*a* could be arranged at the same point, in plan view, as the break 16 in the third partially circumferential frame 15*c*, if the break 16 in the second partially circumferential frame 15*b* is at a different point in plan view.

However, the breaks 16 preferably always have a rotational offset with respect to one another in plan view.

Figure 6A:
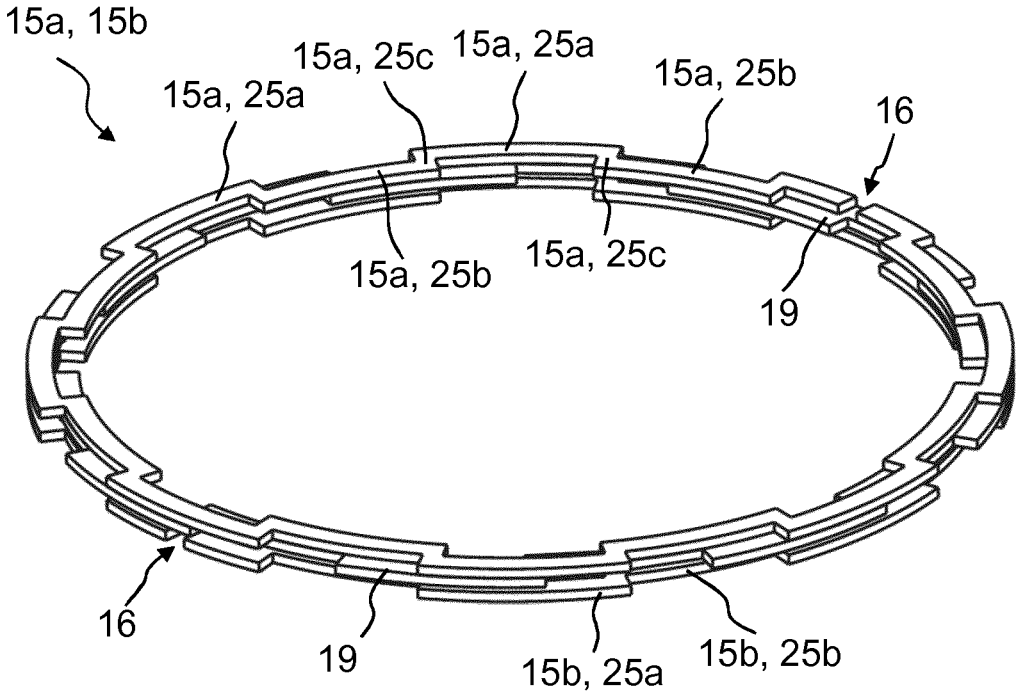
FIG. 6A to 6C are different spatial views of two mutually parallel partially circumferential frames, the basic shape of which differs from an exact circular shape.
Figure 6B:
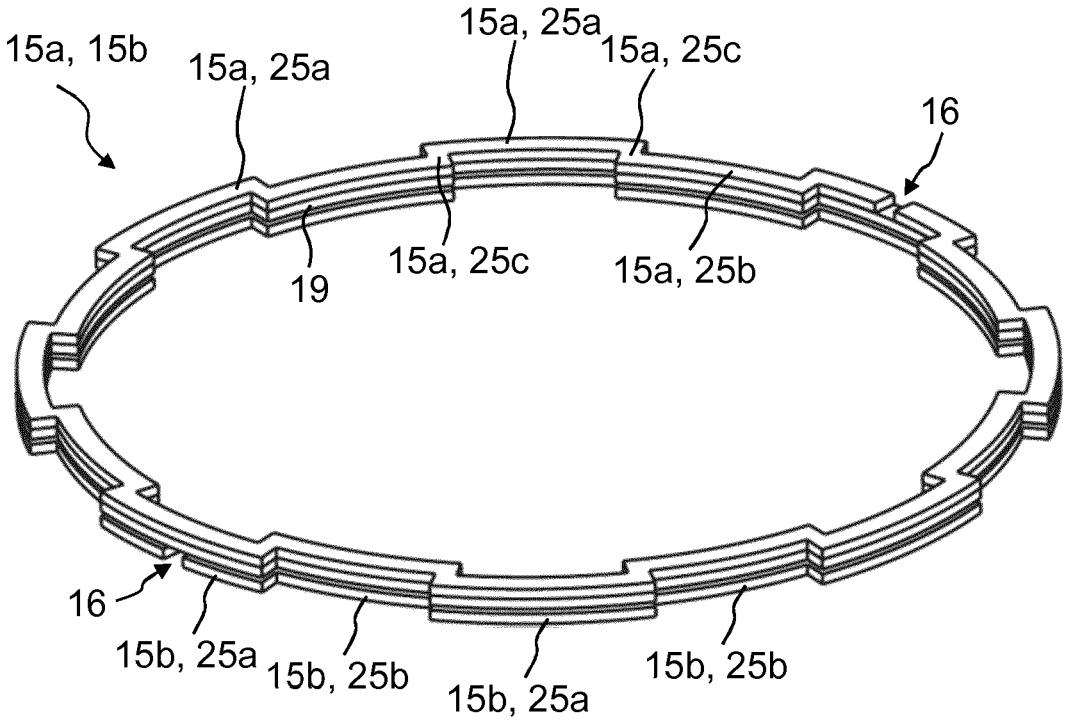
Figure 6C:
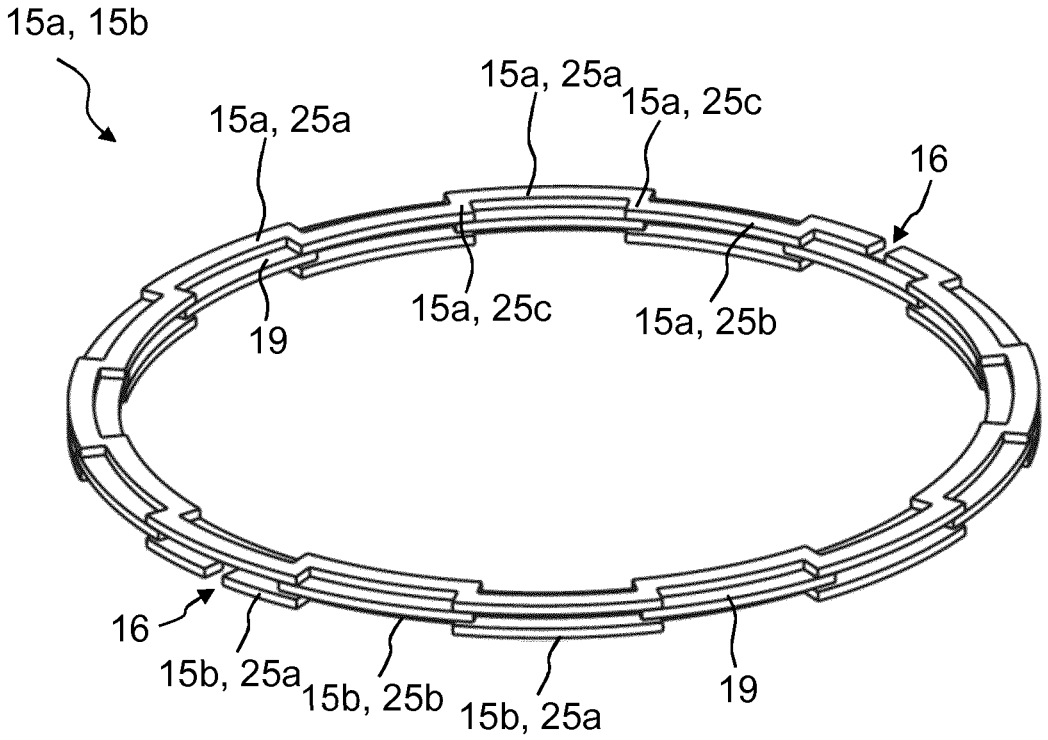

FIG. 6A to 6C show a further embodiment of the at least two partially circumferential frames 15*a*, 15*b*. A dielectric medium 19*d*, preferably consisting of plastics material, is located between the two partially circumferential frames 15*a*, 15*b*. The two partially circumferential frames 15*a*, 15*b* each comprise a plurality of frame portions 25*a*, 25*b*, the spacings between the individual frame portions 25*a*, 25*b* and a longitudinal axis 8 that passes through the centre of the dipole-type radiator arrangement 1 changing alternately from a larger spacing to a smaller spacing and vice versa. In FIG. 6A to 6C, the two partially circumferential frames 15*a*, 15*b* are in the shape of a cog, or the individual frame portions 25*a*, 25*b* extend in an approximately meandering manner.

The individual frame portions 25*a*, 25*b* are interconnected by means of a connecting portion 25*c*. Said connecting portion 25*c* preferably extends radially. The at least two partially circumferential frames 15*a*, 15*b* preferably each comprise more than three, more preferably more than five, frame portions 25*a*, 25*b*. There are preferably just two different types of frame portions 25*a*, 25*b*. There could also be further frame portions 25*a*, 25*b* and/or further types of frame portions 25*a*, 25*b*. Said further types of frame portions would be characterised in that they would be arranged further from the longitudinal axis or closer to the longitudinal axis (compared with the other frame portions 25*a*, 25*b*).

Overall, however, the two partially circumferential frames 15*a*, 15*b* comprising the respective frame portions 25*a*, 25*b* still extend so as to be circular.

In each partially circumferential frame 15*a*, 15*b*, the at least one break 16 is made in one of the frame portions.

The frame portion 25*a* that is further from the longitudinal axis 8 may also be referred to as the outer frame portion 25*a*. In contrast, the frame portion 25*b* that is closer to the longitudinal axis 8 is also referred to as the inner frame portion 25*b*. In this case, the ends of an inner frame portion 25*b* are connected, by means of two connecting portions 25*c*, to two outer frame portions 25*a*. The same also applies to an outer frame portion 25*a*, the ends of which are connected, by means of two connecting portions 25*c*, to two inner frame portions 25*b*.

In a plan view of the dipole-type radiator arrangement 1, the shape of the dielectric medium 19 is matched to the shape of the relevant partially circumferential frame 15*a*, 15*b*. With respect to FIG. 6A to 6C, the dielectric medium 19 also comprises portions that are closer to the longitudinal axis 8 than other portions which are spaced further apart therefrom. The two portions change alternately.

With respect to FIG. 6A, the two partially circumferential frames 15*a*, 15*b* are congruent in plan view (with the exception of the breaks 16), whereas the dielectric medium 19 has a rotational offset, of a specified angular position, relative to the partially circumferential frames 15*a*, 15*b*. If the sum of the inner and outer frame portions 25*a*, 25*b* of a partially circumferential frame 15*a*, 15*b* is m, then the dielectric medium 19 would preferably have a rotational offset of an angle β which is calculated in accordance with $\beta=360°/2\ m$ (in this case, 11.25°).

In contrast, in FIG. 6B the dielectric medium 19 is arranged so as to be congruent with the at least two partially circumferential frames 15*a*, 15*b* 15*a*, 15*b*.

In FIG. 6C, in contrast, the dielectric medium 19 has a further rotational offset relative to the at least two partially circumferential frames 15*a*, 15*b* compared with FIG. 6A. In FIG. 6C, an outer portion of the dielectric medium 19 rests on the at least two partially circumferential frames 15*a*, 15*b*, below or above an inner frame portion 25*b*. In this case, the dielectric medium 19 has a rotational offset of an angle γ relative to the two partially circumferential frames 15*a*, 15*b*, said angle being calculated in accordance with γ=360°/m (in this case 22.5°).

FIG. 2 also shows an additional reflector 6 on which the base 10 of the dipole-type radiator arrangement 1 is arranged. The reflector 6 is trough-shaped. This means that the reflector 6 comprises a reflector base body 6*a* which is adjoined by at least two reflector walls 6*b*. An angle between the reflector walls 6*b* and the reflector base body 6*a* is preferably greater than 90°. The reflector 6 could also be exclusively in one plane.

Figure 7A:
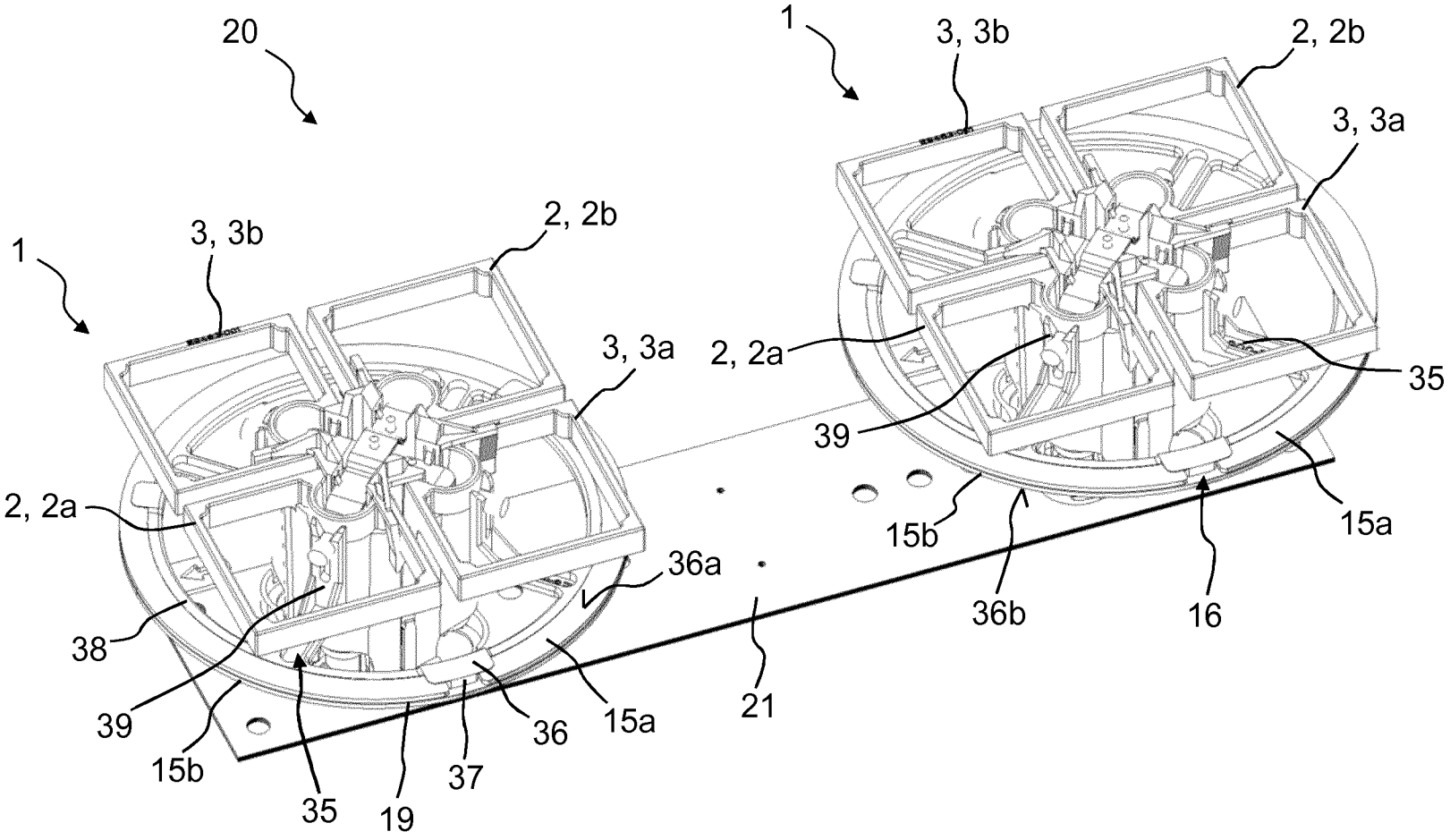
FIG. 7A to 7C are different spatial views of the antenna array according to the invention comprising two dipole-type radiator arrangements.
Figure 7B:
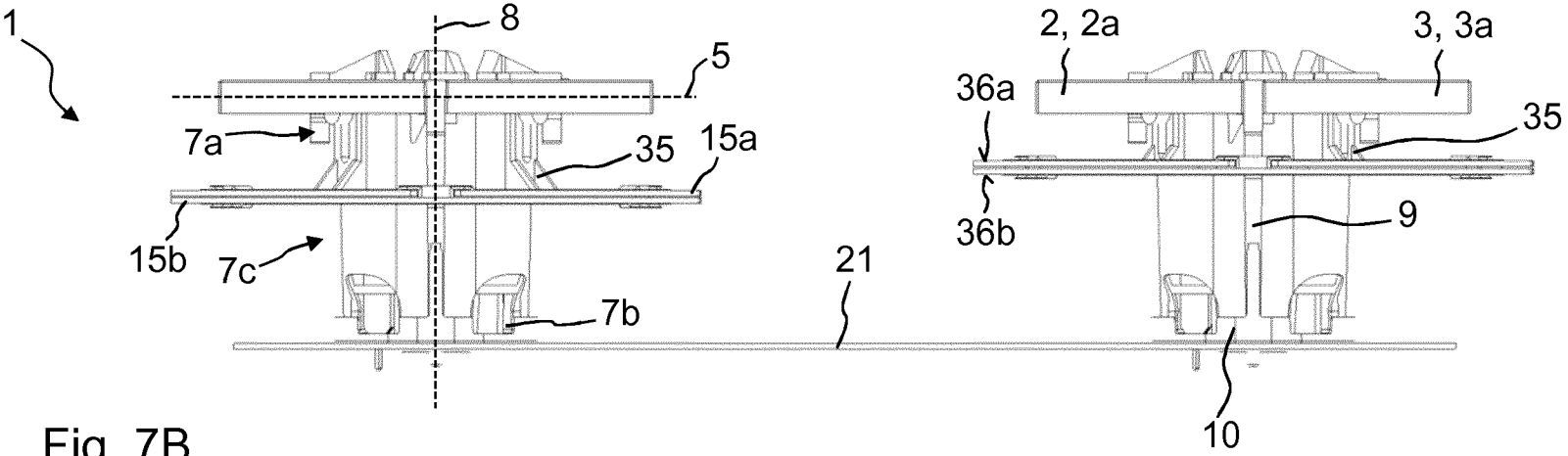
Figure 7C:
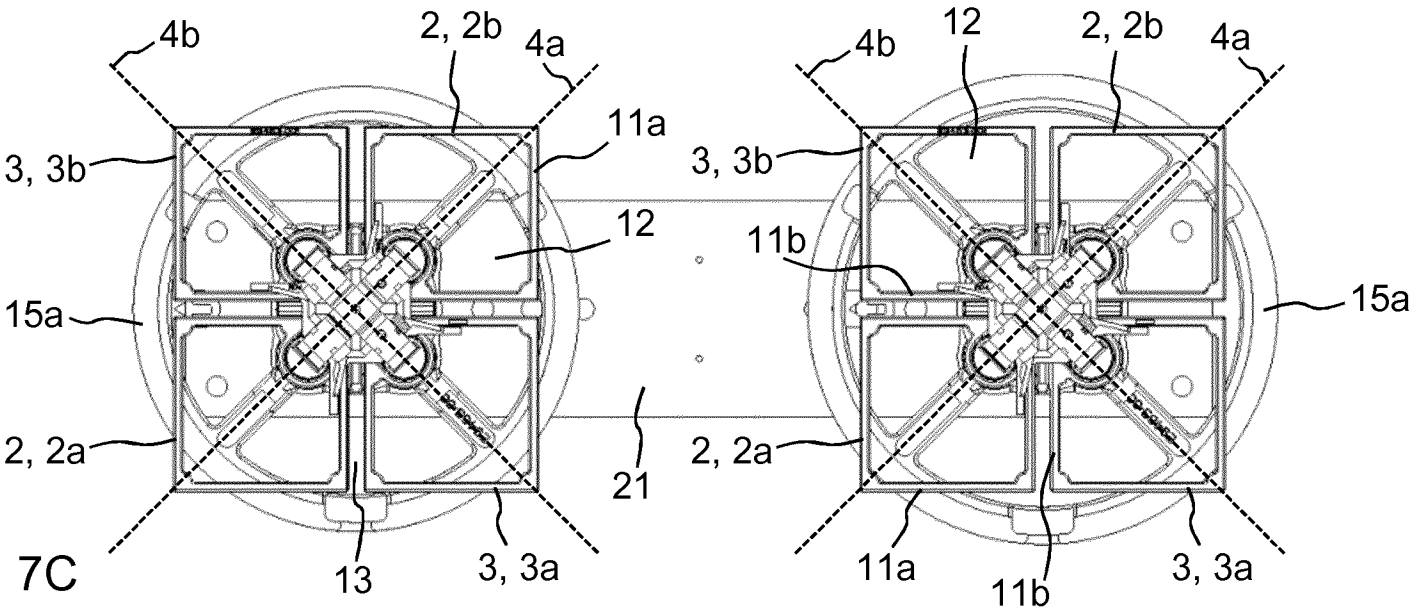

FIG. 7A to 7C show the antenna array 20 which comprises at least two dipole-type radiator arrangements 1, the dipole-type radiator arrangements 1 preferably being designed identically to one another and being oriented in the same manner. The spacing between the two dipole-type radiator arrangements 1 is preferably set such that MIMO (multiple input multiple output) operation is possible. Said spacing could also be selected such that different frequency bands can be served using the different dipole-type radiator arrangements 1.

In this case, the two dipole-type radiator arrangements 1 are arranged on a common circuit board 21. Said circuit board 21 may be screwed to the reflector 6, as shown in FIG. 2.

Each dipole-type radiator arrangement 1 comprises at least two partially circumferential frames 15*a*, 15*b*. Said partially circumferential frames 15*a*, 15*b* are retained by means of at least one retaining and spacer element 35. Said at least one retaining and spacer element 15*a*, 15*b* comprises at least one retaining clamp 36. Said at least one retaining clamp 36 encloses the at least two partially circumferential frames 15*a*, 15*b*. In this case, the at least one retaining clamp 36 rests on the outer surface 36*a*, 36*b* of the two outer partially circumferential frames 15*a*, 15*b*. The at least one retaining clamp 36 is preferably U-shaped. The retaining clamp 36 may be pre-loaded, such that an additional force acts on the surfaces 36*a*, 36*b* of the two outermost partially circumferential frames 15*a*, 15*b*, as a result of which the at least two partially circumferential frames 15*a*, 15*b* are additionally pushed together. This may be desirable in particular if a dielectric medium 19 consisting of plastics material is arranged between the respective partially circumferential frames 15*a*, 15*b*.

The at least one retaining and spacer element 35 is preferably formed in one piece together with the at least one retaining clamp 36 in a plastics injection-moulding process.

The retaining clamp 36 does not necessarily need to be formed on the retaining and spacer element 35. For example, one end of the retaining and spacer element 35 could be supported on the reflector 6 or the circuit board 21, and the other end of said element could retain or enclose the partially circumferential frames 15*a*, 15*b*.

The at least one retaining clamp 36 further comprises a support portion 37. The support portion 37 is arranged inside or plunges into a break 16 in the partially circumferential frame 15*a*, 15*b*. As a result, the two end faces of the two ends 18, which ends are formed on the partially circumferential frame 15*a*, 15*b* by means of the break 16, can be supported on the support portion 37. This increases the stability of the overall assembly. The retaining clamp 36, together with the support portion 37, preferably no longer protrudes beyond the periphery of the at least two partially circumferential frames 15*a*, 15*b*.

The at least one retaining and spacer element 35 preferably comprises a support profile 38. The outer face of the support profile 38 is matched to the contour of at least one partially circumferential frame (preferably of all the partially circumferential frames) 15*a*, 15*b* and is of a length that corresponds to at least a partial length of the partially circumferential frame 15*a*, 15*b*. The inner face of the at least one partially circumferential frame 15*a*, 15*b* is supported on the at least one support profile 38. In this case, preferably all the partially circumferential frames 15*a*, 15*b*, 15*c* may be supported on the support profile 38.

The retaining and spacer element 35 is preferably formed in one piece, i.e. integrally, together with the at least one retaining clamp 36, the support portion 37 and the support profile 38.

The at least one retaining and spacer element 35 which retains the at least two partially circumferential frames 15*a*, 15*b* is preferably fastened to the dipole-type radiator arrangement 1 and/or to the base body 6, 21. In order to ensure tool-free fastening of the at least one retaining and spacer element 35 to the dipole-type radiator arrangement 1, the at least one retaining and spacer element 1 comprises a force-locked and/or form-locked connection 39. Said force-locked and/or form-locked connection 39 is provided in particular in the form of a clip or snap connection. The at least one retaining and spacer element 35 can be retained on one or all of the radiator halves 2*a*, 2*b*, 3*a*, 3*b* or on the carrier assembly 7 by means of said force-locked and/or form-locked connection 39.

A dielectric medium 19 is inserted between the two partially circumferential frames 15*a*, 15*b*. A dielectric medium of this kind may also be a spacer. As a result, the individual partially circumferential frames 15*a*, 15*b* are galvanically separated from one another. Said dielectric medium 19 or said dielectric spacer may be formed in one piece together with the retaining and spacer element 35 which, as already mentioned, comprises the at least one retaining clamp 36 comprising the retaining portion 37 and the support profile 38. Said assembly also comprises the force-locked and/or form-locked connection 37 which is preferably arranged at the opposite end of the retaining and spacer element 35, on which the retaining clamp 36 is formed.

In the embodiment in FIG. 7A to 8C, each dipole-type radiator arrangement 1 comprises four retaining and spacer elements 35.

With respect to FIGS. 7B and 7C, it can be seen that the individual partially circumferential frames 15*a*, 15*b* have a larger diameter than is the case in the radiator halves 2*a*, 2*b*, 3*a*, 3*b*.

The outside diameter of the individual partially circumferential frames 15*a*, 15*b* is less than 150% of the wavelength of the centre frequency, preferably less than 120%, more preferably less than 100%, even more preferably less than 80% of the wavelength of the centre frequency, and is more than 10% of the wavelength of the centre frequency, preferably more than 40%, or more than 80%, or more than 120%, or more than 140% of the wavelength of the centre frequency.

In another embodiment, the outside diameter of the individual partially circumferential frames is 20% to 80% of the wavelength of the centre frequency. Said wavelength is preferably 30% to 70%, more preferably 40% to 60%, and even more preferably 50% of the wavelength of the centre frequency.

The inside diameter of the individual partially circumferential frames 15*a*, 15*b* may be of a similar order of magnitude. However, said inside diameter is preferably only of a length that corresponds to less than 99% of the length of the outside diameter of the individual partially circumferential frames 15*a*, 15*b*. The length is more preferably less than 95%, even more preferably less than 90%, even more preferably less than 80%, even more preferably less than 70%, even more preferably less than 60% and even more preferably less than 50% of the length of the outside diameter of the individual partially circumferential frames 15*a*, 15*b*. Preferably, however, said length is more than 10% or 20% or 30% or 50% or 60% or 70% or 80% of the length of the outside diameter.

Owing to the design according to the invention of the dipole-type radiator arrangement 1, said radiator arrangement operates in a very broad bandwidth and is suitable for use in a frequency range of from 500 MHz to 5000 MHz. Said arrangement can also serve frequency ranges of which the frequency limit is less than 4500 MHz, or less than 4000 MHz, or less than 3500 MHz, or less than 3000 MHz, or less than 2700 MHz, the lower frequency limit preferably being over 500 MHz, or over 600 MHz, or over 800 MHz, or over 900 MHz, or over 1200 MHz, or over 1500 MHz, or over 1800 MHz, or over 2000 MHz, or over 2500 MHz, or over 3000 MHz. In particular, a frequency range of between 1400 MHz and 2690 MHz is covered.

The spacing between the individual partially circumferential frames 15*a*, 15*b* is between 0.1 and 0.5 mm. However, said spacing can also be larger or smaller.

Figure 8A:
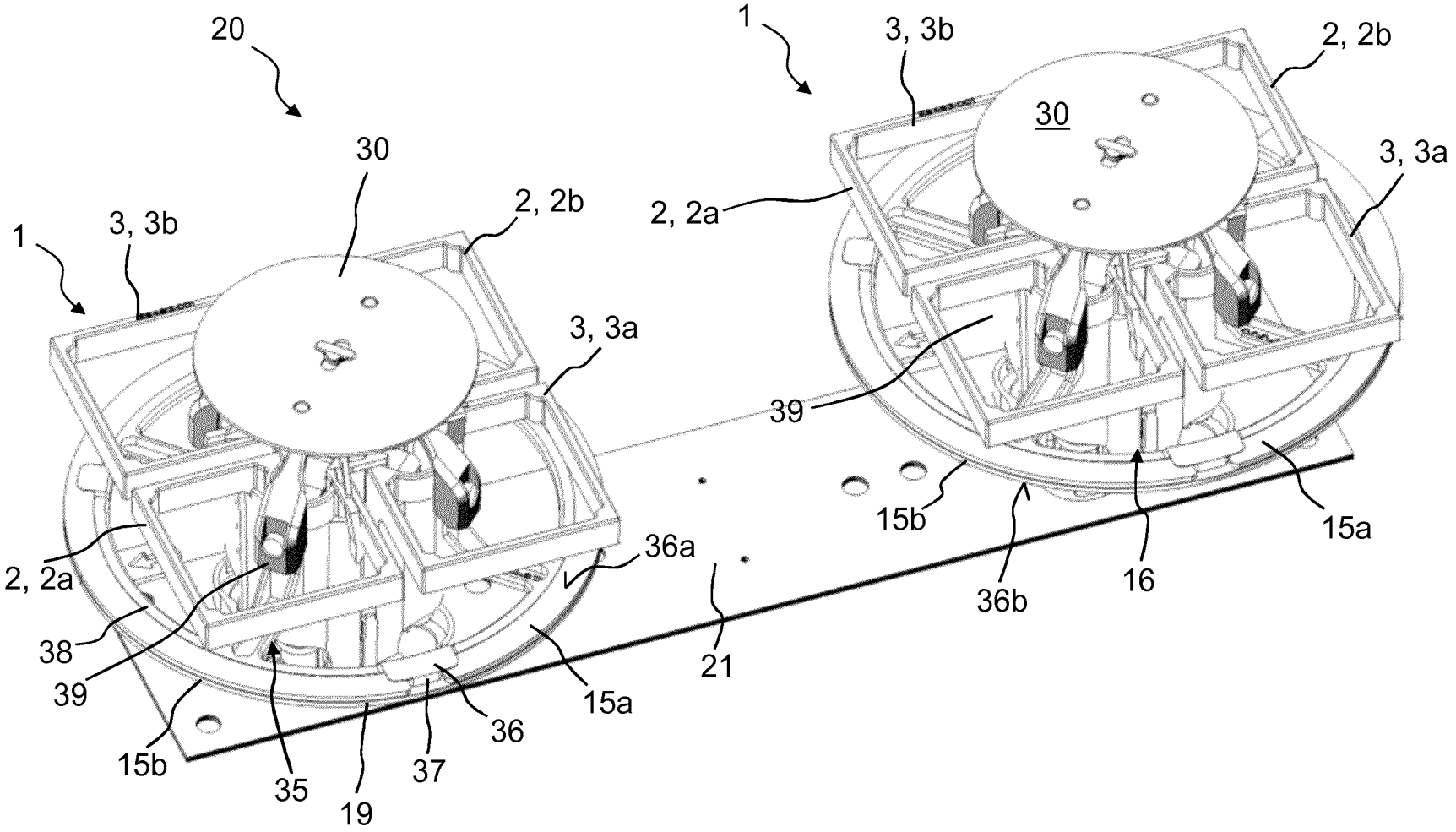
FIG. 8A to 8C are different spatial views of the antenna array according to the invention comprising two dipole-type radiator arrangements which additionally comprise a director.
Figure 8B:
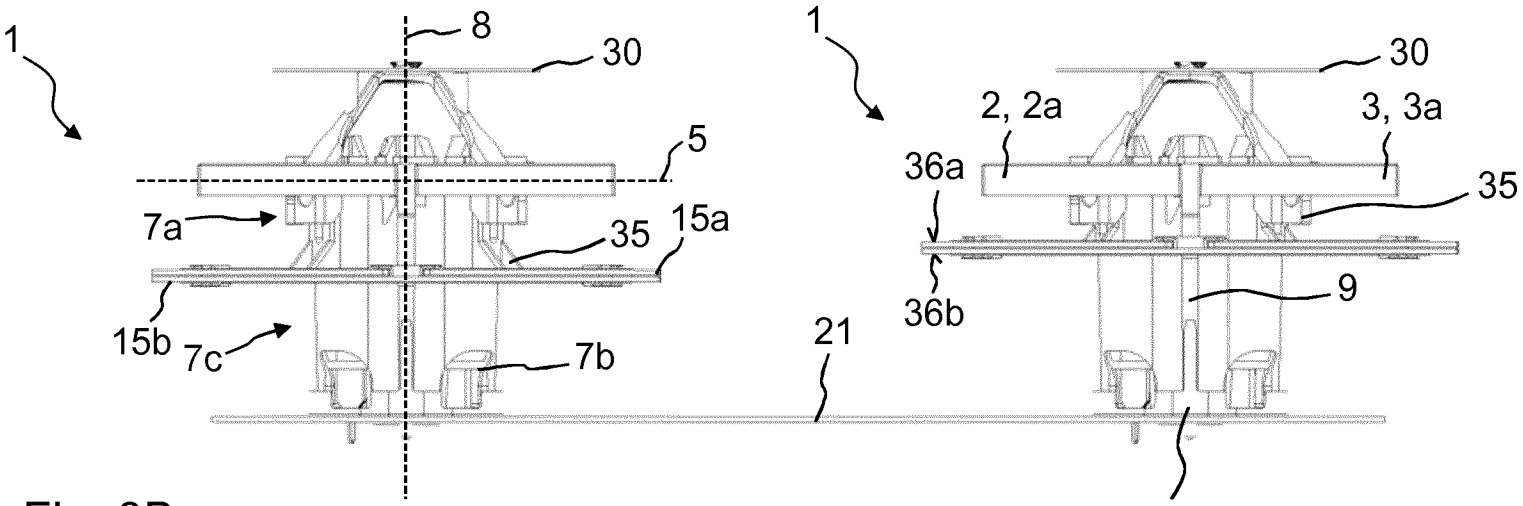
Figure 8C:
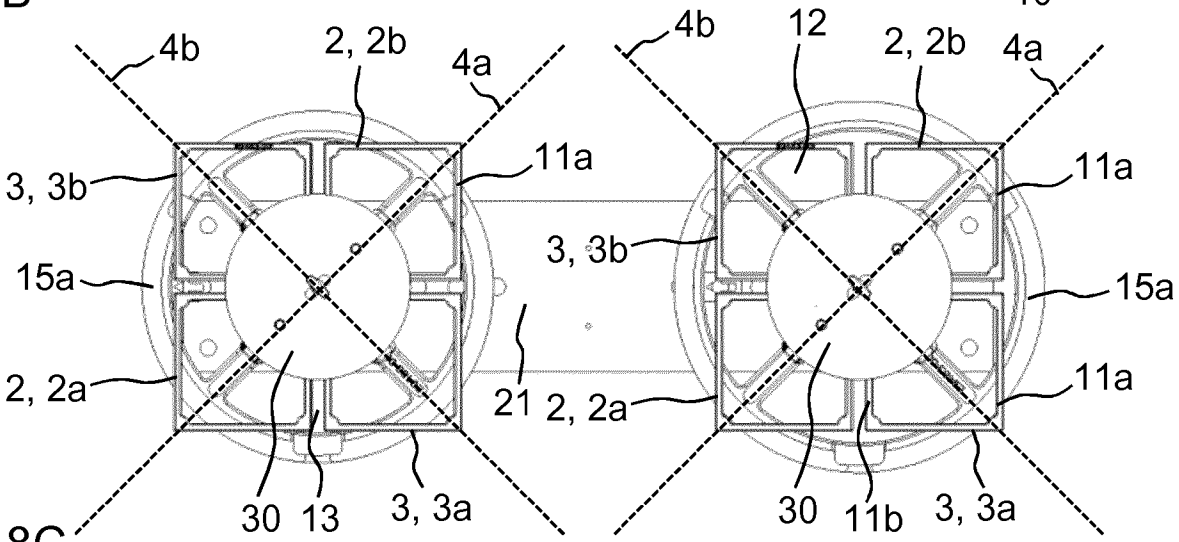

FIG. 8A to 8C also show an antenna array 20 comprising at least two dipole-type radiator arrangements 1. Said antenna array is formed substantially in accordance with the antenna array 20 as has been described with respect to FIG. 7A to 7C and to which reference is made here.

Unlike the above embodiment, each dipole-type radiator arrangement 1 further comprises a director 30 that is likewise oriented in parallel with the radiator plane 5. The director 30 has a round cross section in plan view. Other cross-sectional shapes are also conceivable. In this case, the radiator halves 2*a*, 2*b*, 3*a*, 3*b* are arranged closer to the base 10 than the director 30 is. This means that the director 30 is arranged, together with the radiator halves 2*a*, 2*b*, 3*a*, 3*b* and the partially circumferential frames 15*a*, 15*b*, 15*c*, on the same side of the reflector 6 or, in general terms, of the base body 6, 21, and so as to be spaced apart therefrom. In this case, compared with the radiator halves 2*a*, 2*b*, 3*a*, 3*b* and the partially circumferential frames 15*a*, 15*b*, 15*c*, the director 30 is furthest from the point of the reflector 6 or of the base body 6, 21 to which the second end 7*b*, i.e. the base 10, of the carrier assembly 7 is attached. The director 30 preferably has a smaller diameter than the partially circumferential frames 15*a*, 15*b*.

The partially circumferential frames 15*a*, 15*b*, 15*c* are preferably each formed in one piece by means of a punching process. The same also applies for the two pairs 2, 3 of radiator halves 2*a*, 2*b* and 3*a*, 3*b*, respectively, which are formed in one piece, together with the carrier assembly 7, in a punching process. Said elements could also be shaped by means of an additional bending process.

It should be noted that, with regard to the dimensioning of the length for the individual elements, all intermediate ranges are considered to be disclosed.

The dipole-type radiator arrangement 1 is designed in particular in the form of a vector dipole, crossed dipole or quad dipole.

The longitudinal axis 8 is also a central axis 8 that passes through the centre of the dipole-type radiator arrangement 1, specifically perpendicularly to the reflector plane or radiator plane 5.

The invention is not limited to the embodiments described. Within the context of the invention, all the features that have been described and/or shown can be combined with one another as desired.

The invention claimed is:

1. An antenna array comprising at least one dipole-type radiator arrangement, the at least one dipole-type radiator arrangement comprising:

two pairs of radiator halves which are arranged having a mutual rotational offset of 90° such that the dipole-type radiator arrangement transmits and/or receives in two mutually perpendicular polarization planes;

the radiator halves are arranged in a radiator plane in parallel with and so as to be at a spacing in front of a reflector;

a carrier assembly comprising a first end and a base that is arranged at a second end that is opposite the first end, the radiator halves being arranged on the first end of the carrier assembly, and the base capable of being arranged on a base body;

at least two electrically conductive partially circumferential frames, which frames are arranged between the radiator plane and the base so as to be mutually spaced in the height direction of the carrier assembly, the at least two electrically conductive partially circumferential frames each defining an opening;

the at least two partially circumferential frames being oriented in parallel with the radiator plane;

each of the two partially circumferential frames comprising at least one break which extends through the entire width (b) of the partially circumferential frame, such that each partially circumferential frame comprises at least two ends.

2. The antenna array comprising at least one dipole-type radiator arrangement according to claim 1, wherein:

each break in a partially circumferential frame forms two ends which are mutually adjacent and/or face one another.

3. The antenna array comprising at least one dipole-type radiator arrangement according to claim 1, wherein:

the at least two partially circumferential frames are mutually parallel or are inclined towards one another by less than 5° or by less than 3° or by less than 1° and are galvanically separated from one another.

4. The antenna array comprising at least one dipole-type radiator arrangement according to claim 1, further comprising:

at least one retaining and spacer element that retains or encloses the at least two partially circumferential frames; and/or the at least one retaining and spacer element resting on the outer surfaces of the two outermost partially circumferential frames.

5. An antenna array comprising at least one dipole-type radiator arrangement according to claim 4, wherein:

the at least one retaining and spacer element comprises at least one retaining clamp; the at least one retaining clamp comprises a support portion; and the support portion is arranged inside a break in the partially circumferential frame, as a result of which two end faces of the two ends, which ends are formed on the partially circumferential frame by means of the break, are supported on the support portion.

6. An antenna array comprising at least one dipole-type radiator arrangement according to either claim 4, wherein:

the at least one retaining and spacer element comprises a support profile;

the support profile is matched to the contour of at least one partially circumferential frame and of a length that corresponds to at least a partial length of the partially circumferential frame; and the inner face of the at least one partially circumferential frame is supported on the at least one support profile.

7. The antenna array comprising at least one dipole-type radiator arrangement according to claim 4, wherein:

the at least one retaining and spacer element is retained on one or on all of the radiator halves or on the carrier assembly by means of a force-locked and/or form-locked connection, in particular in the form of a clip or snap connection.

8. The antenna array comprising at least one dipole-type radiator arrangement according to claim 3, wherein:

at least one dielectric spacer is arranged between the individual partially circumferential frames, as a result of which the individual partially circumferential frames are galvanically separated from one another; and the at least one dielectric spacer and the at least one retaining and spacer element are formed in one piece.

9. The antenna array comprising at least one dipole-type radiator arrangement according to claim 1, wherein:

in a plan view of each of the partially circumferential frames, the at least one break extends over less than 30%, or over less than 20%, or over less than 10%, or over less than 5%, of the length of the partially circumferential frame.

10. The antenna array comprising at least one dipole-type radiator arrangement according to claim 1, wherein:

the at least two partially circumferential frames are arranged so as to have a mutual rotational offset; and in plan view, the breaks in the at least two partially circumferential frames overlap only in part or do not overlap at all.

11. An antenna array comprising at least one dipole-type radiator arrangement according to claim 1, wherein:

each of the partially circumferential frames comprises a plurality of breaks, thereby forming a plurality of partially circumferential frame segments.

12. An antenna array comprising at least one dipole-type radiator arrangement according to claim 6, wherein:

at least one of the partially circumferential frame segments of one partially circumferential frame is longer than the other partially circumferential frame segment(s) of the partially circumferential frame; or all the partially circumferential frame segments of one partially circumferential frame are of the same length.

13. The antenna array comprising at least one dipole-type radiator arrangement according to claim 1, wherein:

the at least one break in the at least two partially circumferential frames comprise first and second breaks that have a rotational offset of $\alpha=360°/n$ with respect to one another, n being the sum of the total number of the first and second breaks in the at least two partially circumferential frames.

14. The antenna array comprising at least one dipole-type radiator arrangement according to claim 1, wherein:

in plan view, the at least two partially circumferential frames are arranged so as to be approximately circular or so as to describe a circle overall; and/or the at least two partially circumferential frames are of the same width in plan view.

15. The antenna array comprising at least one dipole-type radiator arrangement according to claim 1, wherein:

the at least two partially circumferential frames each comprise a plurality of frame portions, the spacings between the individual frame portions and a longitudinal axis that passes through the center of the dipole-type radiator arrangement changing alternately from a larger spacing to a smaller spacing;

the individual frame portions being interconnected by means of a connecting portion.

16. The antenna array comprising at least one dipole-type radiator arrangement according to claim 15, wherein:

with the exception of the breaks, the at least two partially circumferential frames are arranged, together with the frame portions thereof having the alternating spacing from the longitudinal axis, so as to be congruent or so as to have a mutual rotational offset in plan view.

17. An antenna array comprising at least one dipole-type radiator arrangement according to claim 15, wherein:

at least one dielectric medium is inserted between two partially circumferential frames in each case;

in a plan view of the dipole-type radiator arrangement, the shape of the dielectric medium is matched to the shape of the relevant partially circumferential frame;

in a plan view of the dipole-type radiator arrangement, the at least one dielectric medium is arranged so as to be congruent with or so as to have a rotational offset with respect to the relevant partially circumferential frame.

18. The antenna array comprising at least one dipole-type radiator arrangement according to claim 1, wherein:

a director, the director being oriented in parallel with the radiator plane; the radiator halves are arranged closer to the base than the director is.

19. An antenna array comprising at least one dipole-type radiator arrangement according to claim 1, wherein:

with the exception of the break, the at least two partially circumferential frames overlap one another completely or at least in part in plan view.

20. The antenna array comprising at least one dipole-type radiator arrangement according to claim 1, wherein:

the at least two partially circumferential frames have an outside diameter that is of a length in the range of from 20% to 200%, or 30% to 150%, or 40% to 100% of the wavelength of the center frequency.

21. The antenna array comprising at least two dipole-type radiator arrangements, each of the at least two dipole-type radiator arrangements being formed according to claim 1, wherein:

the at least two dipole-type radiator arrangements are arranged on a common base body.

* * * * *